United States Patent [19]

Foreman et al.

[11] Patent Number: 4,844,749

[45] Date of Patent: Jul. 4, 1989

[54] REAGENT BATH FOR AND METHOD OF TREATING A WORKPIECE SURFACE

[76] Inventors: Robert W. Foreman, 4353 Covered Bridge Rd., Bloomfield Hills, Mich. 48013; Michael T. Ives, 14147 Hannan, Romulus, Mich. 48174

[21] Appl. No.: 131,517

[22] Filed: Dec. 11, 1987

[51] Int. Cl.[4] ..... C23C 22/72

[52] U.S. Cl. ..... 148/242; 148/15; 148/20

[58] Field of Search ..... 148/6.11, 15, 20

[56] References Cited

U.S. PATENT DOCUMENTS 1,549,409 8/1925 Gravell ..... 148/6.15 R
4,181,540 1/1980 Ahlf ..... 148/6.2

FOREIGN PATENT DOCUMENTS 47-47776 12/1972 Japan ..... 148/6.15 Z

*Primary Examiner*—Sam Silverberg
*Attorney, Agent, or Firm*—Krass & Young

[57] ABSTRACT

A bath for treating a metallic workpiece so as to provide a surface finish thereupon includes a reagent adapted to react with the surface and an abrasive material. Relative agitational motion between the abrasive and the workpiece is provided and in this manner the abrasive promotes uniform reaction of the workpiece surface with the reagent so as to provide a uniform, deposit-free coating. Also within the scope of the present invention is a method for treating workpiece surfaces utilizing such a bath.

21 Claims, 1 Drawing Sheet

REAGENT BATH FOR AND METHOD OF TREATING A WORKPIECE SURFACE

FIELD OF THE INVENTION

This invention relates in general to the treatment of workpiece surfaces, particularly to baths for treating metallic workpieces and more specifically to high temperature oxidizing baths for producing a blackened finish on ferrous articles.

BACKGROUND OF THE INVENTION

Treatment baths of various types are widely used for purposes of providing an aesthetically pleasing or protective finish upon an article. Typical of such baths are those employed in treating metals. There are numerous varieties of such bath compositions, and reagents therefor used in the treatment of metal articles. For example, oxidizing or nitriding baths are frequently used to improve the hardness and/or color characteristics of fabricated metal articles. Problems arise however, in the use of such baths because of nonuniformity of reaction of the metal surface therewith.

The instant invention, as will be apparent from the discussion and description which follow, is applicable to a wide variety of reagent baths; however, for purposes of illustration, it will be described primarily with reference to heat treating baths of the type utilized in conjunction with processes for the nitriding, carbonitriding or oxidizing of the surfaces of ferrous articles. It has previously been known to treat ferrous articles via various vapor phase or molten salt bath processes to produce a hard coating thereupon. For example, a bath of molten cyanide-containing salts may be employed to create a hard nitride or carbonitride case and similarly, various proprietary gaseous atmospheres including mixtures of carbon monoxide, hydrogen, nitrogen, ammonia and the like are employed at various temperatures to similarly treat workpiece surfaces.

While such treatments are in wide commercial use, they by themselves are not fully adequate for all metal finishing needs insofar as problems with corrosion and quality of appearance frequently occur. Coatings produced by various of the molten salts processes tend to be rather porous and consequently manifest poor corrosion resistance. As a consequence, such parts are treated by immersion in a rust inhibitor bath so as to fill the pores thereof in a process generally referred to as "oiling out." Articles treated by the gas phase process have a lower degree of porosity and hence are not fully amenable to an oiling out process, however they do still to have sufficient porosity to create problems of corrosion. Additionally, articles treated by either of said processes often manifest a poor physical appearance insofar as the coatings may appear mottled or otherwise unappealing. In an attempt to approve the appearance of such articles, resort is often had to oxidizing baths. Such baths typically include molten nitrate or nitrite salts and optionally caustic compounds therein and function to convert an outer layer of the metallic article to black iron oxide ($Fe_3O_4$)

While there are various processes for blackening ferrous articles, all suffer from common inadequacies. Oftentimes the reaction between the oxidizing reagent and the ferrous article is not uniform, consequently a mottled or blotched appearance results. In other instances, an undesirable residue, referred to as "smut," is formed upon the article. The smut, is generally believed to be a mixture of amorphous iron oxide and nitride, and aside from being aesthetically unappealing, tends to rub off and stain items in contact with the oxidized surface.

Accordingly, it will be appreciated that there is a need for a process which can reduce the formation of mottling or smut in such oxidation processes. It will also be appreciated that problems resultant from nonuniform reaction and/or generation of unwanted deposits can also occur in other types of treatment processes and accordingly it would be similarly desirable to eliminate such problems.

The present invention provides an improved reagent bath which promotes uniform reaction and eliminates smut formation. According to the present invention, a reagent bath includes therein an abrasive material agitated with respect to the article being treated. It has been found that the abrasive interacts with the surface being treated so as to renew the reactive centers thereupon, remove loosely adherent material, and remove deviant morphologies and other unwanted reaction products. As a result, the reagent is free to react optimally with the surface. This synergy between the abrasive and the reagent results in superior coating formation.

The present invention has great utility in various processes for the heat treating of metallic surfaces and may be readily extended to various other coating or surface conversion processes where unwanted by-products, deviant morphologies, and surface deposits interfere with the formation of a uniform surface layer. These and other features and advantages of the present invention will be readily apparent from the drawings, discussions, and descriptions which follow.

BRIEF DESCRIPTION OF THE INVENTION

There is disclosed herein a method of providing a surface finish on a metallic workpiece, the method includes the steps of providing a surface treatment bath, said bath including a reagent adapted to react with the surface of the workpiece and an abrasive material. The method includes the further step of immersing the workpiece in the bath and providing for relative agitational motion between the abrasive material and the workpiece. In this manner the abrasive material promotes the uniform reaction of the workpiece surface with the reagent. In a particular embodiment, the bath is a heat treatment bath and the method includes the further step of maintaining the heat treatment bath at an elevated temperature. In particular embodiments the bath may be an oxidizing bath including at least one molten salt therein. The bath may specifically include nitrates, nitrites and metal hydroxides.

The abrasive material may be selected from the group consisting essentially of sand, metal oxides, metal carbides, silicon carbide and combinations thereof. One particular surface treatment bath comprises 30 to 70 percent of a reagent comprised of approximately 50 percent $KNO_3$, 45 percent $NaNO_3$ and 5 percent NaOH along with 30–60 percent of an $Al_2O_3$ abrasive of 60–80 mesh. Another specific surface treatment bath comprises 30–70 percent of a mixture of approximately 53 percent $KNO_3$, 40 percent $NaNO_2$, and 7 percent $NaNO_3$ together with 30–60 percent of sharp sand of 30–100 mesh.

Relative agitational motion between the abrasive material and the workpiece may be provided for by agitating the abrasive material as for example by stirring the material. In other embodiments, relative agitational motion may be achieved by vibrating the workpiece either with or without agitational motion of the abrasive. There is also provided according to the present invention, a surface treatment bath comprised in accord with the foregoing.

DETAILED DESCRIPTION OF THE INVENTION

The present invention is adaptable to any surface treatment process wherein a workpiece surface and a reagent are contacted so as to produce a surface finish. According to the present invention, an abrasive material is added to the treatment bath and relative agitational motion is established between the workpiece and the abrasive. B "relative agitational motion" is meant that either the workpiece or the abrasive material is agitated with respect to the other so as to provide for a kinetic contact therebetween. For example, the reagent bath may include an abrasive dispersed or suspended therein and the bath may be stirred so a to provide for a relative agitational motion. Conversely, the workpiece may be moved as for example by vibrating, shaking or other such motion so as to provide for kinetic contact with the abrasive material.

In general, the abrasive will be employed as a powder or fine granular material and toward that end it will generally be found most advantageous to stir the reagent bath so as to maintain the abrasive in suspension and to provide for the relative agitational motion. In some instances it may be desirable to stir the abrasive containing bath while vibrating or otherwise moving the workpiece.

This relative agitational motion between the workpiece and the abrasive provides for superior surface finishes, not attainable by the use of the reagent material alone or by the use of the reagent in combination with subsequent abrasive polishing. It is generally believed that the action of the abrasive, during the reagent treatment process functions to remove unwanted deposits from the workpiece so as to promote the formation of a uniform, adherent coating.

In general, any chemical reaction will undergo side reactions productive of unwanted materials. In the coating process, such side reactions can produce the wrong chemical deposit, as for example, a deposit of a higher or lower oxide or deposit of a complex material or a deposit of an impurity. Similarly, the reagent and workpiece may react to produce the right chemical species but in a deviant morphology; as for example, a spongy, columnar or loosely adherent coating may form upon the article. The presence of the abrasive material in the reagent bath serves to remove such loosely adherent deposits and scrub away undesired species, thereby constantly renewing the workpiece surface. By proper control of the amount of abrasive scrubbing and the reaction of the reagent, growth of a smooth, uniform, tightly adherent coating may be achieved.

Although the instant invention may be carried out in conjunction with any coating process, including for example electroplating processes, electrolessplating processes, anodizing or other oxidizing processes, reduction processes or etching processes, the present invention has been found to be particularly useful in connection with the treatment of ferrous metals via an oxidizing and/or nitriding process.

Figure 1:
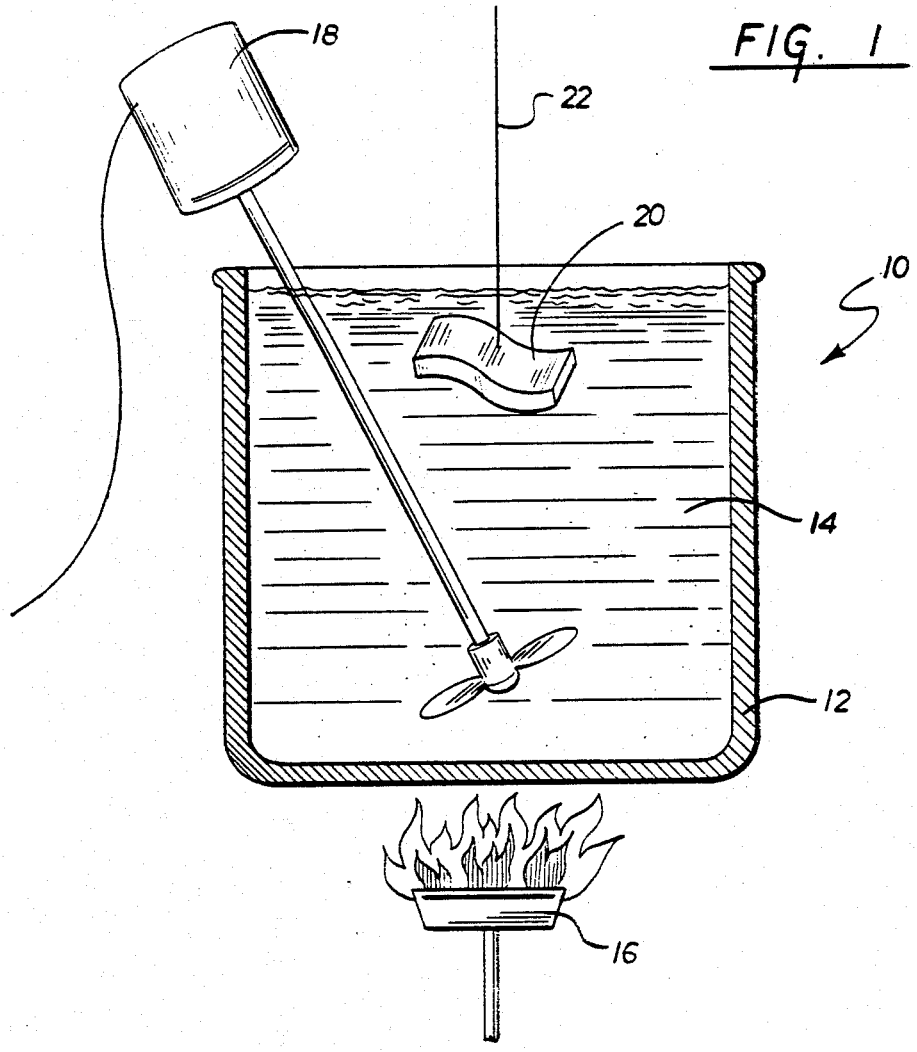
FIG. 1 is a cross-sectional, stylized depiction of one particular apparatus which may be used in conjunction with the method of the present invention.

Such processes are typically carried out at elevated temperatures in molten salt baths. FIG. 1 depicts a molten salt bath apparatus 10 as may be utilized for the practice of the present invention. The apparatus 10 is disposed within a reaction vessel 12 which is typically a heat resistant vessel formed from stainless steel, graphite or other such high-temperature resistant material. The vessel 12 is provided with a molten salt reagent bath 14 therein and is maintained at an elevated temperature by a heat source such as a gas burner 16. It should be understood that other heat sources such as induction heaters, resistance heaters , and the like may be similarly employed. The bath 14 is stirred by means of a mechanical stirrer 18 of the type well-known to those of skill in the art. Such stirrers are available in a wide variety of sizes and styles, and may be driven by electrical power, magnetic power, compressed air or internal combustion engines.

Shown in the bath is a workpiece 20 maintained by a support rod 22, it being kept in mind that a basket, conveyer or other such means may be similarly used to support one or more workpieces in the bath.

In operation the bath 14 will include an abrasive material therein such as sand, or a metallic oxide such as alumina, magnesium oxide, cerium oxide, iron oxide as well other abrasive compounds such as silicon carbide. The choice of abrasive will depend upon the hardness of the workpiece, and the compatibility of the abrasive with the bath conditions. It has generally been found that alumina or sand are low in cost, relatively inert and provide sufficient abrasion for most processes.

The reagent is disposed in the vessel 12 and maintained at elevated temperature by means of the heat source 16. Obviously, temperature controllers such as thermostats and the like may be employed in combination with this bath as is well-known to those of skill in the art. The stirrer 18 is activated to maintain the abrasive material in suspension and to provide for the requisite relative agitational motion between that abrasive and the workpiece 20. The workpiece 20 is inserted in the bath 14 for a period of time which will depend upon the composition of the bath, the temperature of the bath, and the thickness of coating to be formed upon the workpiece 20. Various examples of treatment condition will be detailed hereinbelow.

Figure 2:
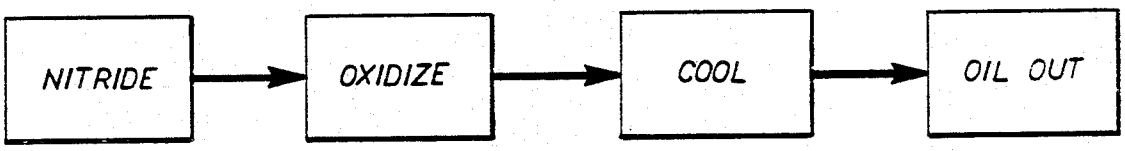
FIG. 2 is a block diagram of a particular metal finishing operation as conducted in accord with the principles disclosed herein.

Referring now to FIG. 2, there is shown a simplified block diagram of one particular treatment protocol in which the present invention is employed. Depicted in the figure is a process for finishing of ferrous articles via a combination of nitriding and oxidizing. Such processes are typically employed to impart hardness, corrosion resistance and a pleasing surface finish to a wide variety of ferrous articles. In the first step, the article is nitrided via any one of the aforedescribed processes. For example, the article may be treated in a molten cyanide bath so as to produce a conversion coating of iron nitride and/or iron carbide. The process whereby coating of nitride and carbide is formed is generally referred to as ferritic nitrocarburizing. Following the conversion coating, the workpiece may be optionally rinsed and/or tempered at an elevated temperature. In other instances the workpiece may be directly transferred to an oxidizing bath, generally similar to that depicted in FIG. 1. Here the workpiece will be maintained at an elevated temperature in contact with an oxidizing reagent as, for example, a mixture of potassium and sodium nitrates and/or nitrites, optionally with sodium hydroxide, together with the appropriate abrasive material. Workpieces are typically maintained in such baths for 10–30 minutes at temperatures ranging from 600°–800° F. After the oxidation process is complete, the workpiece is cooled either by slow cooling in air or in a protective atmosphere or by immersion in a quench bath. Concurrent with, or subsequent to the cooling, the oxidized workpiece is washed, dried and subjected to an oiling out process wherein it is immersed in a bath containing a surface protective agent such as an oil or proprietary rust inhibitor. The oiling out process may be carried out in any one of the proprietary baths provided for this purpose. Generally such baths fall into three categories. The first includes water displacing, solvent based baths and employ an oil dissolved in a water immiscible solvent of high penetrating power such as light mineral spirits. Such baths displace water, then evaporate to leave a residual oil layer. The second type, referred to as emulsion type baths generally comprise an aqueous dispersion of an oily protective material, and operate to leave a residue of that material upon an article. In the third instance, oiling out may be most simply accomplished by immersing the article in a heated bath of the protective oil. Obviously there are other baths anticipated and used, for example, a water miscible solvent such as an alcohol or ketone may have a protective oil dissolved therein. Generally, any such bath may be used in conjunction with the process disclosed herein. While oiling out is generally highly desirable for optimal corrosion protection, the exact nature of the process is not particular to the instant invention.

It has been found that workpieces thus treated manifest a gray-black to blue-black finish, a slight gloss and produce no smutty deposits. Reference to the following examples will better explain specific embodiments of this process.

EXAMPLES

In this experimental series, a number of 1042 alloy steel bars were initially subjected to identical nitriding processes and subsequently treated in various oxidizing baths. The samples were assessed for visual appearance, the formation of smut as measured by wiping with a fine paper, and in some instances surface roughness. All samples were ⅝ by 1.5 inch in size and were initially polished to a 15.0 microinch RMS finish. In particular noted instances, the samples were oiled out with various proprietary materials such as Parkote 34 produced by the Park Chemical Company of Detroit, Mich., or Tectyl 603, produced by the Atlantic Richfield Corporation of Los Angeles, Calif.; both of which are protectants of the water dispersing type.

EXAMPLE 1

This was a control sample which was not treated in an oxidizing bath nor oiled. Immediately upon nitriding, the sample was quenched into a 2% brine solution maintained at 180° F. The visual appearance presented was a light gray, spotty, velvet finish. Smut deposits were fine-textured and quite heavy.

EXAMPLE 2

This sample was identical to that of Example 1 except that after a brine quench, it was washed in water and oiled out in Parkote 34. The visual appearance presented was a dark gray, spotty, matte finish. Smut deposits were quite heavy.

EXAMPLE 3

This sample was treated in an oxidizing bath comprised of essentially 45% sharp sand of 30–100 mesh and 55% of a salt mixture comprised of approximately 53% $KNO_3$, 40% $NaNO_2$ and 7% $NaNO_3$. The bath was maintained at 800° F. plus or minus 10 degrees in a gas-fired pot of approximately 17 inches in diameter and 30 inches in depth. An electric motor driven agitator with a 3-blade propeller and a long shaft was mounted above the bath for purposes of stirring. The motor was approximately 2-horsepower and turned at a fixed speed. The test sample was maintained in the bath for approximately 20 minutes and subsequently quenched in water. The finished part presented a uniform, dark gray, matte finish with no noticeable smut formation.

EXAMPLE 4

In this example, a sample was oxidized in a bath comprised of approximately 45% alumina abrasive of 60–80 mesh and 55% of a salt mixture consisting of 50% potassium nitrate, 45% sodium nitrate and 5% sodium hydroxide. The salt bath was maintained at 650° F. in a vessel generally similar to that described with reference to Example 3. The sample was maintained in the molten salt bath for approximately 10 minutes and then water-quenched. This produced a uniform, matte black finish with no smut formation.

EXAMPLE 5

In this experiment, a salt bath generally similar to that of Example 4 was employed, however, the sample was maintained therein for approximately 30 minutes and water-quenched. The visual appearance and smut formation were substantially identical to that of Example 4.

EXAMPLE 6

In this example, a sample was immersed in a bath substantially identical to that of Examples 4 and 5, but without any abrasive material therein. The bath was maintained at 750° F. and the part was treated for 30 minutes. The sample presented a spotty, dark gray, matte finish and exhibited heavy smut formation.

EXAMPLE 7

In this example, a sample was treated under conditions generally similar to those of Example 3, however after water-quenching, it was dipped in an oiling bath of Parkote 34. The treated sample presented a uniform semi-glossy dark gray finish with no smut formation.

EXAMPLE 8

In this example, the sample was treated as per Example 3 but after water-quenching, was dipped in an oiling bath including Tectyl 603. The thus treated part also exhibited a uniform semi-glossy dark gray finish with no smut formation.

EXAMPLE 9

This procedure was substantially similar to that of Example 4, however the quenched part was dipped in a bath of Parkote 34. The treated sample presented a uniform, semi-glossy, black finish and no smut formation.

EXAMPLE 10

This sample was treated substantially similarly to that of Example 5, but was also given a final treatment in Parkote 34. It manifested a uniform, semi-glossy, black finish and no smut formation.

EXAMPLE 11

This sample was treated in a bath substantially similar to that of Example 4 but after water washing was dipped in a bath of Tectyl 603 and manifested a uniform, semi-glossy, black finish and no smut formation.

EXAMPLE 12

This sample was treated under conditions substantially similar to those of Example 5 but was also dipped in a bath of Tectyl 603 and manifested a uniform, semi-glossy, black finish and no smut formation.

EXAMPLE 13

This sample was treated under conditions substantially similar to those of Example 6 but was oiled out in a bath of Parkote 34. It manifested a non-uniform, gray-black finish and medium smut formation.

EXAMPLE 14

This sample was treated under conditions substantially similar to those of Example 5, however after oxidizing, it was mechanically polished and subsequently oiled out in a Parkote 34 bath. The sample exhibited a uniform, glossy gray finish and no smut formation.

SURFACE ROUGHNESS MEASUREMENTS

All of the samples were initially polished to a measured surface roughness of 15 microinches RMS. After treatment selected parts were remeasured to assess the effect, if any, of the abrasive. Surface roughness measurements were made on the finished parts of Examples 8, 11, 12, 13 and 14; which exhibited a RMS surface roughness of 18.5, 12.2, 17.3, 12.2 and 8.7, respectively. The conclusion to be drawn from this is that within experimental scatter, the abrasive bath and the corresponding non-abrasive bath had no significant effect upon surface roughness. Mechanical polishing as was done in Example 14, did significantly decrease surface roughness.

CONCLUSION

The conclusion to be drawn from the foregoing series of experiments is that a nitriding process provides a light to medium gray article having a significant degree of smut formation. Treatment of such articles in a non-polishing, oxidizing bath provides the nitrided articles with a non-uniform matte finish of gray to black color and produces relatively heavy smut formation. Inclusion of abrasive material in the oxidizing bath causes the formation of a smut-free, even finish having a gray to deep black color, depending upon bath composition. Surface texture of the finish is not significantly altered by such abrasive treatment.

While several particular combinations of reagent have been detailed, such compositions have generally been selected because of commercial availability, proper melting point and the like. Accordingly, the fact that precise compositions are given should not be taken as indicative of the need for such compositions. The principles disclosed herein can be employed with similar baths of slightly different composition as well as other distinct types of reagent bath.

It can be seen from the foregoing that the present invention provides for a treatment bath in which an abrasive material and a reagent synergistically react with a workpiece surface to produce a finish thereupon superior to that which could be obtained by either reagent alone. It should be kept in mind that, while the present invention has been described with reference to a oxidizing bath for use with ferrous articles, these principles may obviously be extended to any treatment process wherein an agent reacts with the surface of a workpiece, particularly processes wherein formation of uniform coatings and/or elimination of unwanted deposits is desired. As such the present invention has utility in processes for plating, reducing, oxidizing, nitriding or otherwise treating article surfaces and accordingly, the foregoing drawings, description, discussion and examples are merely meant to be illustrative of particular embodiments of the present invention. It is the following claims, including all equivalents, which are meant to define the scope of the invention.

We claim:

1. A method of providing a surface finish on a metallic workpiece, said method including the steps of:

providing an oxidizing bath, said bath maintained at an elevated temperature and including at least one molten salt reagent adapted to react with the surface of the workpiece so as to form an oxidized coating thereon and an abrasive material;

immersing the workpiece in the bath; and providing for relative agitational motion between the abrasive material and the workpiece, whereby the abrasive material promotes the uniform reaction of the workpiece surface with the reagent.

2. A method as in claim 1, wherein the step of providing said oxidizing bath comprises providing a bath including a nitrate salt therein.

3. A method as in claim 1, wherein the step of providing said oxidizing bath comprises providing a bath including a nitrite salt therein.

4. A method as in claim 1, wherein the step of providing said oxidizing bath comprises providing a bath including an alkaline metal hydroxide therein.

5. A method as in claim 1, wherein the step of providing a bath including an abrasive therein includes the further step of selecting said abrasive material from the group consisting essentially of sand, metal oxides, metal carbides, silicon carbide, and combinations thereof.

6. A method as in claim 1, wherein the step of providing an oxidizing bath comprises providing a bath including 30–70% of a reagent comprised of approximately 50% $KNO_3$, 45% $NaNO_3$, and 5% NaOH; and 30–60% of an $Al_2O_3$ abrasive of 60–80 mesh.

7. A method as in claim 1, wherein the step of providing an oxidizing bath comprises providing a bath including 30–70% of a reagent comprised of approximately 53% $KNO_3$, 40% $NaNO_2$ and 7% $NaNO_3$; and 30–60% of sharp sand of 30–100 mesh.

8. A method as in claim 1, wherein the step of providing for relative agitational motion between the abrasive material and the workpiece includes the step of agitating the abrasive material.

9. A method as in claim 1, wherein the step of providing for relative agitational motion between the abrasive material and the workpiece comprises vibrating the workpiece.

10. A method as in claim 1, wherein the step of providing for the relative agitational motion between the abrasive material and the workpiece comprises agitating the abrasive material and vibrating the workpiece.

11. A vessel containing an oxidizing bath for providing a finish on a metallic workpiece, said bath comprising:

a reagent including at least one molten salt adapted to react with and oxidize the surface of the workpiece so as to form an oxidized coating thereon;

an abrasive material disposed in the reagent in a amount sufficient to promote the uniform reaction of the workpiece surface with the reagent; and means for providing for the relative agitational motion of the abrasive with respect to the workpiece.

12. A vessel bath as in claim 11, further including means for maintaining said bath at an elevated temperature.

13. A bath as in claim including a nitrate salt therein.

14. A bath as in claim 11, including a nitrite salt therein.

15. A bath as in claim 11, including an alkaline metal hydroxide therein.

16. A bath as in claim 11, wherein said abrasive material is selected from the group consisting essentially of sand, metal oxides, metal carbides, silicon carbide, and combinations thereof.

17. A bath as in claim 11, including 30–70% of a reagent comprised of approximately 50% $KNO_3$, 45% $NaNO_3$, and 5% NaOH; and 30–60% of an $Al_2O_3$ abrasive of 60–80 mesh.

18. A bath as in claim 11, including 30–70% a reagent comprised of approximately 53% $KNO_3$, 40% $NaNO_2$ and 7% $NaNO_3$; and 30–60% of sharp sand of 30–100 mesh.

19. A vessel as in claim 11, wherein said means for providing for relative agitational motion between the abrasive material and the workpiece is adapted to agitate the abrasive material.

20. A vessel bath as in claim 11, wherein said means for providing for relative agitational motion between the abrasive material and the workpiece is adapted to vibrate the workpiece.

21. A vessel bath as in claim 11, wherein said means for providing for the relative agitational motion between the abrasive material and the workpiece are adapted to agitate the abrasive material and vibrate the workpiece.

* * * * *